US008225441B2

(12) United States Patent
Heroux et al.

(10) Patent No.: US 8,225,441 B2
(45) Date of Patent: Jul. 24, 2012

(54) RECONFIGURABLE PILLOW

(75) Inventors: Steve Heroux, Williston, VT (US); Jianping Cai, Guangdong (CN)

(73) Assignee: HIP Innovations, LLC, Williston, VT (US)

( * ) Notice: Subject to any disclaimer, the term of this patent is extended or adjusted under 35 U.S.C. 154(b) by 317 days.

(21) Appl. No.: 12/725,963

(22) Filed: Mar. 17, 2010

(65) Prior Publication Data

US 2011/0225735 A1 Sep. 22, 2011

(51) Int. Cl.

| | |
|---|---|
| ***A47C 20/00*** | (2006.01) |
| *A47C 20/02* | (2006.01) |
| *A47C 16/00* | (2006.01) |
| *B68G 5/00* | (2006.01) |

(52) U.S. Cl. ..... 5/640; 5/636; 5/655.4; 5/911

(58) Field of Classification Search ..... 5/636, 639, 5/640, 643, 645, 657.5, 657, 655.4, 911; D6/601

See application file for complete search history.

(56) References Cited

U.S. PATENT DOCUMENTS

| | | | | |
|---|---|---|---|---|
| 3,327,330 | A * | 6/1967 | McCullough | 5/640 |
| 3,704,859 | A * | 12/1972 | Josien | 254/93 HP |
| 3,899,797 | A * | 8/1975 | Gunst | 5/655.3 |
| 3,902,456 | A * | 9/1975 | David | 119/28.5 |
| D239,673 | S | 4/1976 | Ziegler | |
| 3,968,529 | A * | 7/1976 | Levin et al. | 5/640 |
| D287,528 | S | 12/1986 | Maxwell et al. | |
| 5,437,070 | A | 8/1995 | Rempp | |
| 5,458,515 | A | 10/1995 | Busetti | |
| D427,791 | S | 7/2000 | Peterson | |
| D429,592 | S | 8/2000 | Dohan | |
| D435,621 | S | 12/2000 | Peterson | |
| 6,386,761 | B1 | 5/2002 | Bohnsack | |
| 6,859,964 | B1 | 3/2005 | Arnott | |
| D510,400 | S | 10/2005 | Rockstad et al. | |
| D539,375 | S | 3/2007 | Peterson | |
| D553,893 | S | 10/2007 | Boutin | |
| D602,299 | S | 10/2009 | Heroux | |
| 2003/0188384 | A1 | 10/2003 | Maldonado | |

* cited by examiner

*Primary Examiner* — Jonathan Liu

(74) *Attorney, Agent, or Firm* — Downs Rachlin Martin PLLC

(57) ABSTRACT

A pillow that can be manipulated into a variety of bent/folded/twisted configurations and can retain each of those configurations until manipulated into a different configuration. The pillow has a segmented toroidal shape and includes an envelope and a flowable fill filling the envelope so that the fill is under positive pressure throughout. The pillow has a plurality of constrictions that, in conjunction with the pressurized fill, provides the pillow with soft hinges that facilitate bending/folding/twisting of the pillow.

20 Claims, 8 Drawing Sheets

RECONFIGURABLE PILLOW

FIELD OF THE INVENTION

The present invention generally relates to the field of pillows. In particular, the present invention is directed to a reconfigurable pillow.

BACKGROUND

Pillows are used for a variety of purposes to support various parts of the body during any of a variety of activities, such as sleeping, driving, relaxing, reading, and working at a computer, to name just a few. In addition to providing support, a primary requirement of a desirable pillow is for it to be comfortable to a user. Typically, conventional pillows are designed for a particular purpose, such as providing neck support or, alternatively, lumbar support. Many conventional pillows also tend to lose their original shape over time and, therefore, suffer from degraded performance over time.

SUMMARY OF THE DISCLOSURE

In one implementation, the present disclosure is directed to a reconfigurable pillow. The pillow includes: a fill comprising a plurality of discrete pieces configured to make the fill flowable; and an envelope containing the fill, the envelope: defining a generally toroidal shape; having an inner peripheral region that is substantially non-stretchable; and including a plurality of transverse constrictions providing the reconfigurable pillow with a corresponding plurality of soft-hinges and with a corresponding plurality of inter-hinge regions located between adjacent ones of the plurality of soft-hinges, wherein the fill is flowable between adjacent ones of the plurality of inter-hinge regions; wherein the fill is provided to the envelope in an amount such that when the reconfigurable pillow is bent from a first shape to a second shape, two or more of the plurality of soft-hinges activate to allow corresponding respective adjacent ones of the plurality of inter-hinge regions to rotate, and the reconfigurable pillow substantially maintains the second shape until the reconfigurable pillow is bent again.

In another implementation, the present disclosure is directed to a reconfigurable pillow. The pillow includes: a flowable fill; and an envelope defining an interior cavity containing the flowable fill, the envelope: defining a generally toroidal shape; having a front portion that is generally circular; having a back portion that is generally circular and connected to the front portion, wherein the back portion is made of a stretchable material having at least a stretchability of at least 50%; having an inner peripheral region that is substantially non-stretchable; including a plurality of transverse constrictions providing the reconfigurable pillow with a corresponding plurality of soft-hinges and with a corresponding plurality of inter-constriction regions located between adjacent ones of the plurality of transverse constrictions, wherein each of the plurality of transverse constrictions allows communication between adjacent ones of the plurality of inter-hinge regions; and a plurality of elastic strips secured to the stretchable material along corresponding respective ones of the plurality of constrictions; wherein the flowable fill is provided within the interior cavity in an amount such that the flowable fill is under positive pressure throughout the interior cavity without any forces being applied externally to the pillow.

BRIEF DESCRIPTION OF THE DRAWINGS

For the purpose of illustrating the invention, the drawings show aspects of one or more embodiments of the invention.

However, it should be understood that the present invention is not limited to the precise arrangements and instrumentalities shown in the drawings, wherein.

DETAILED DESCRIPTION

Figure 1A:
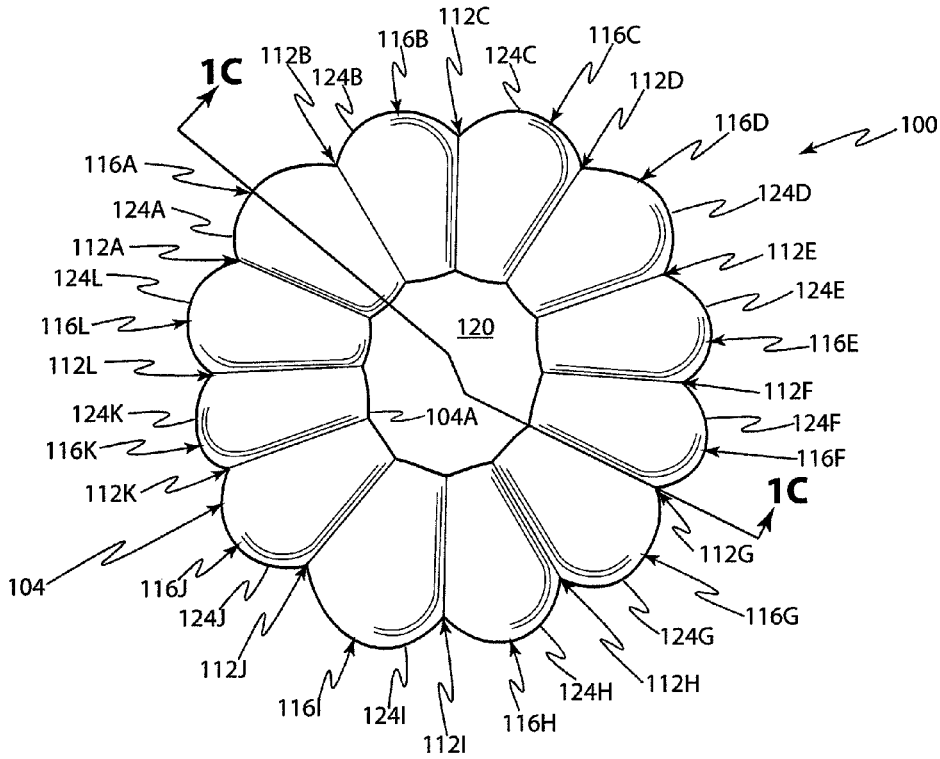
FIG. 1A is a plan view of a reconfigurable pillow made in accordance with the present disclosure, showing the pillow in a flat configuration.
Figure 1B:
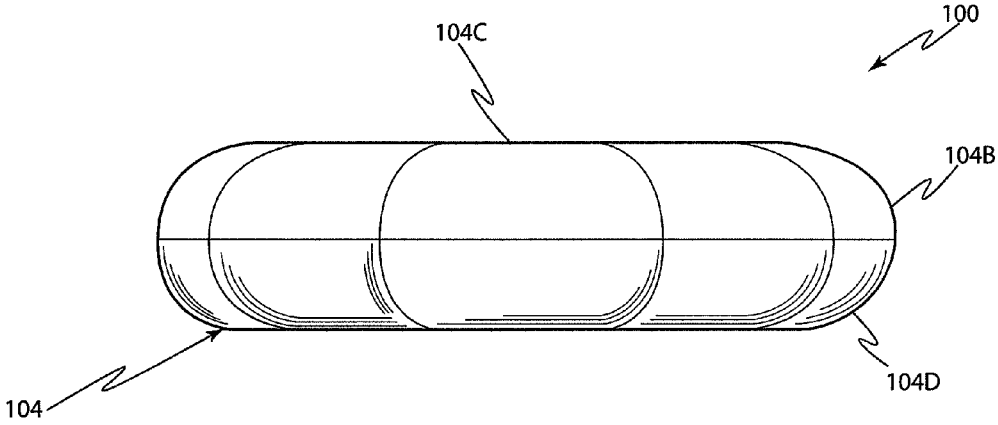
FIG. 1B is an elevational view of the reconfigurable pillow of FIG. 1A showing the pillow in the flat configuration.
Figure 1C:
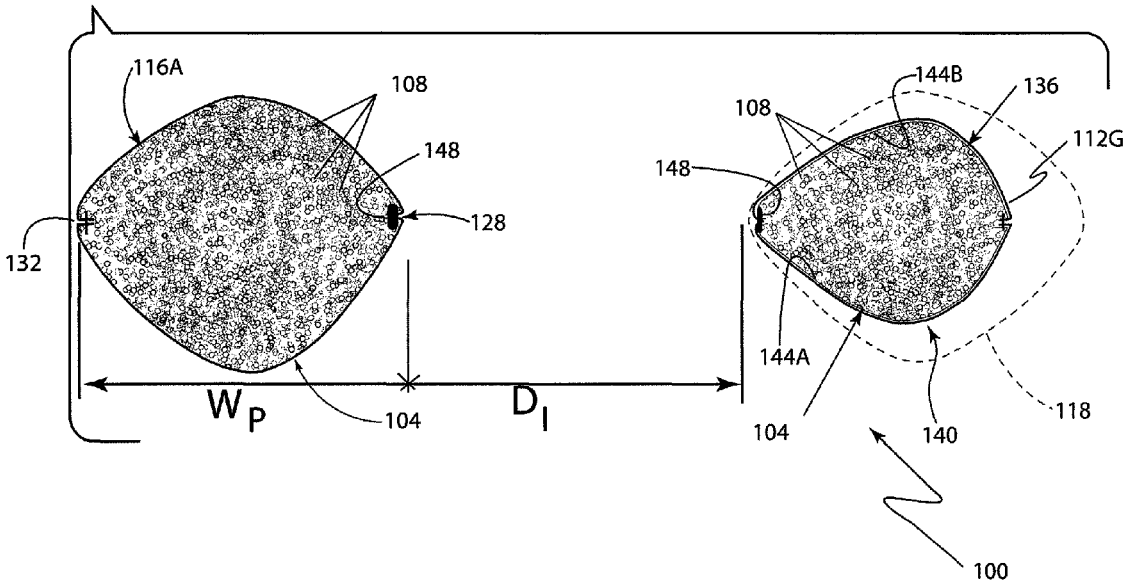
FIG. 1C is an enlarged cross-sectional view as taken along line 1C-1C of FIG. 1A.

Referring now to the drawings, FIGS. 1A-C shows a pillow 100 that is made in such a manner that it has the ability to not only be manipulated (e.g., bent, folded, twisted) into a variety of bent/folded/twisted configurations, but it also remains in each of those configurations until re-manipulated into another configuration. Examples of some of the configurations into which pillow 100 can be manipulated, and set, appear in FIGS. 2A-D, 3B-C and 4B-C. Following is a description of features of pillow 100 that contribute to the pillow having this reconfigurability.

In the following description and in the appended claims the terms "front," "back" and "side" are used for convenience to orient the reader to the various views of pillow 100 depicted in the drawings. It should be appreciated, though, that these terms should not be considered limiting in any way other than providing the reader points of reference for understanding the various views of the drawings and physical relationship of parts in the claims. For example, calling part of pillow 100 the "front portion" should be taken only as being the side facing the viewer when the pillow is in a particular orientation and not constraining that side to having any special functionality or other characteristic by virtue of that label.

With that in mind and again referring to FIGS. 1A-C, pillow 100 includes an envelope 104 that contains a fill 108 (FIG. 1C). As will be described below in detail, envelope 104 includes a number of features that operate in conjunction with particular characteristics of fill 108 to provide pillow 100 with its special reconfigurability. When pillow 100 is in its flat configuration as depicted in FIGS. 1A-C, it can be said to be "segmented-toroidal" in shape. That is, pillow 100 is generally toroidal, i.e., forming a closed ring, and has the appearance of being segmented by virtue of the "constrictions" (twelve constrictions 112A-L in this example), or regions of reduced cross-sectional area as compared to the regions located between the constrictions, i.e., "inter-constriction regions," of which there are twelve (116A-L) in this example. The right-hand side of FIG. 1C highlights the differences in cross-sectional areas of constrictions 112A-L and inter-constriction regions 116A-L by mirroring, as a phantom line 118, the extent of envelope 104 from the left-hand side of FIG. 1C, which is a cross-section at the middle of one of the inter-constriction regions.

Envelope 104 has an inner periphery 104A that, in the flat configuration shown in FIG. 1A, is substantially circular, thereby defining a circular opening 120. Envelope 104 also has an outer periphery 104B that, in this example, is formed by a plurality of elliptical or semicircular arcs 124A-L, each corresponding to a respective one of inter-constriction regions 116A-L. In a particular example of pillow 100 that is suitable for use as a head rest and a head/neck rest, among other things, the diameter, $D_I$, of circular opening 120 is 4 inches (~10.2 cm) and the width, $W_P$, of the pillow as measured from inner periphery 104A of a circle that touches the apexes of arcs is about 4 inches (~10.2 cm). In other embodiments, these dimensions can be larger or smaller as needed to suit a particular use. For example, each of diameter $D_I$ and width $W_P$ may range from 2 inches (~5.1 cm) or smaller to 20 inches (~51 cm) or larger. It is also noted that the number of each of constrictions (112A-L in the embodiment shown) and inter-constriction regions (116A-L in the embodiment shown) does not need to be twelve. In other embodiments, the number of constrictions and inter-constriction regions can be greater or fewer than twelve. That said, it is noted that providing fewer than eight inter-constriction regions may have an undesirable impact on the reconfigurability of the resulting pillow.

Envelope 104 has a front portion 104C and a back portion 104D, which are both made from one or more flexible sheets of suitable material(s). Examples of suitable materials for front and back portions 104C-D include woven fabrics, non-woven fabrics, membranes and films. In some embodiments, at least one of front and back portions 104C-D is made of a relatively highly stretchable material, for example, a woven fabric containing highly elastic strands/fibers, such as spandex, and/or a highly elastic membrane, such as a rubber membrane. As used herein and in the appended claims, a "highly stretchable" material is a material that has a stretchability of at least 40%. Some spandex containing materials have stretchability of 60% to 80% or more. Certain stretchable and non-stretchable materials, such as woven fabrics, can be desirable due to their ability to breathe and, thereby, provide comfort to a user.

In a particular example in which pillow 100 is designed to be soft and gentle to the touch, front portion 104C is made of a 100% polyester fleece woven fabric and back portion 104D is made of a spandex woven fabric of an 85%/15% nylon/spandex blend. The fleece fabric has a relatively low stretchability material relative to the spandex fabric, which has a stretchability of 80%. Hence, in that particular example, front portion 104C is relatively non-stretchable and back portion 104D is relatively stretchable. Contribution of the stretchability of back portion 104D is discussed further below. It is noted that neither of front and back portions 104C-D need to be made of a highly stretchable material, but the reconfigurability of a pillow made in accordance with the present disclosure can be enhanced by having at least one of the front and back portions made of a highly stretchable material.

Figure 1D:
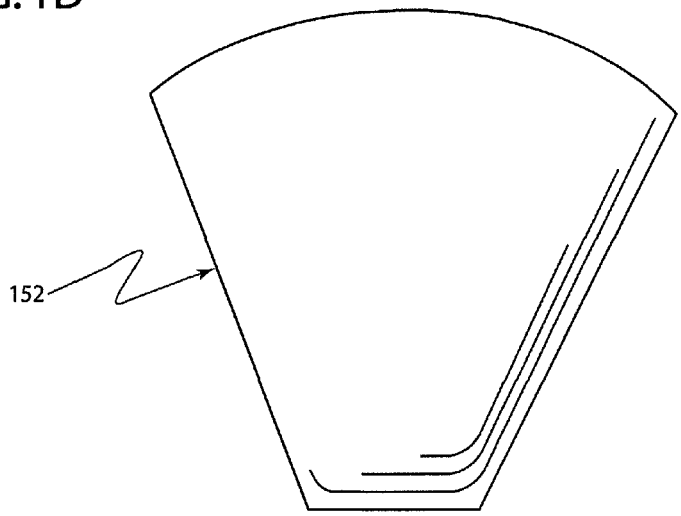
FIG. 1D is an enlarged schematic diagram illustrating the shape of the individual pieces of flexible material that make up the envelope of the pillow of FIG. 1A.
Figure 2A:
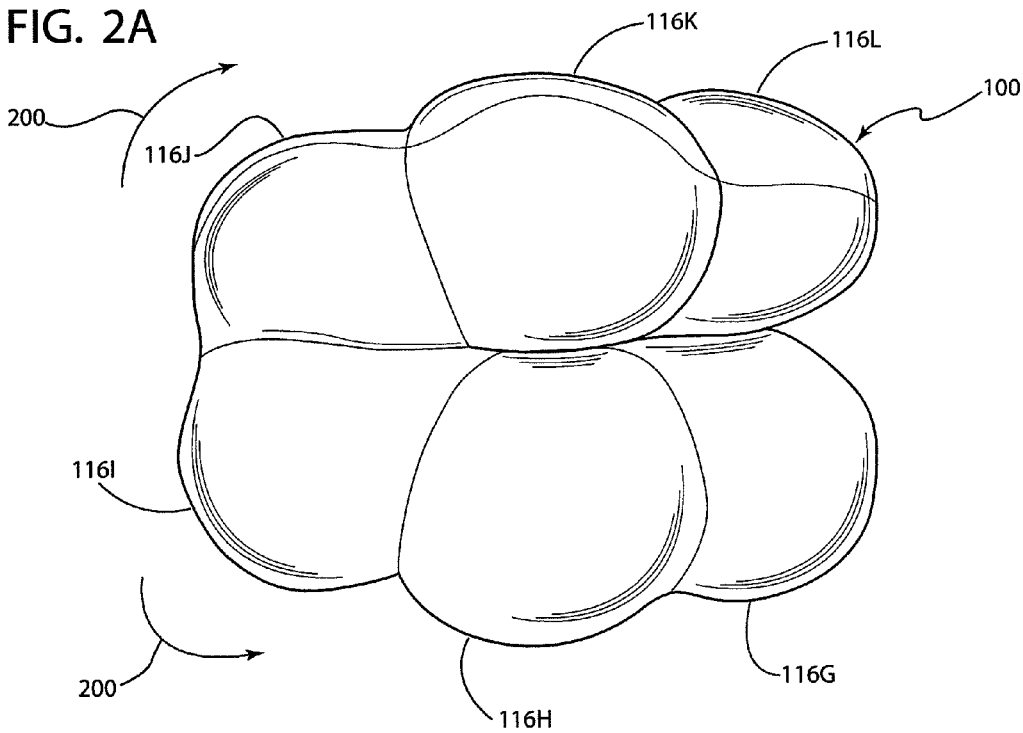
FIG. 2A is a side elevational view of the reconfigurable pillow of FIG. 1A, showing the pillow in a bent configuration.
Figure 2B:
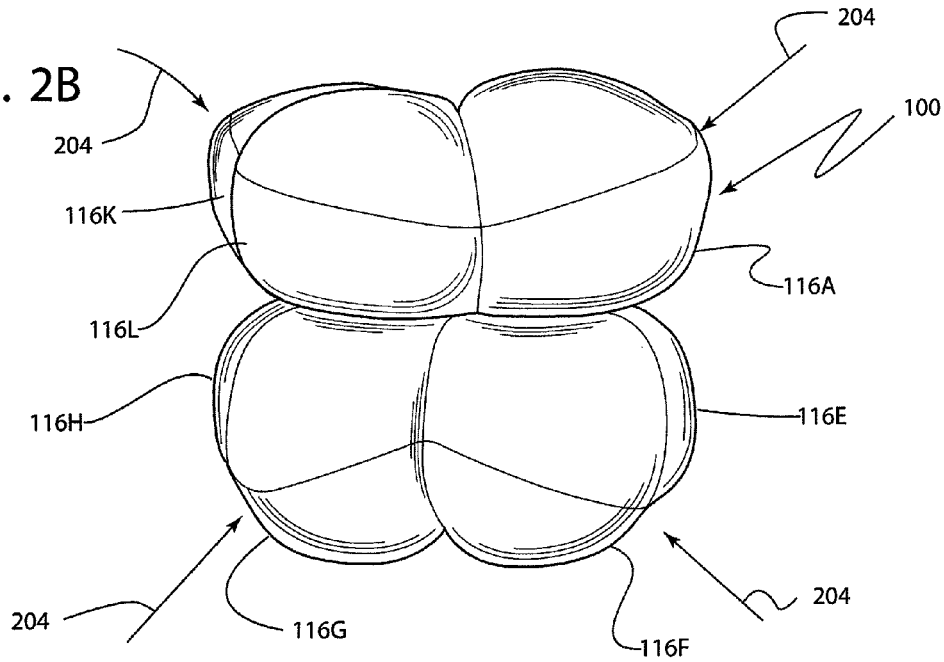
FIG. 2B is a front elevational view of the reconfigurable pillow of FIG. 1A, showing the pillow in the bent configuration of FIG. 2A.
Figure 2C:
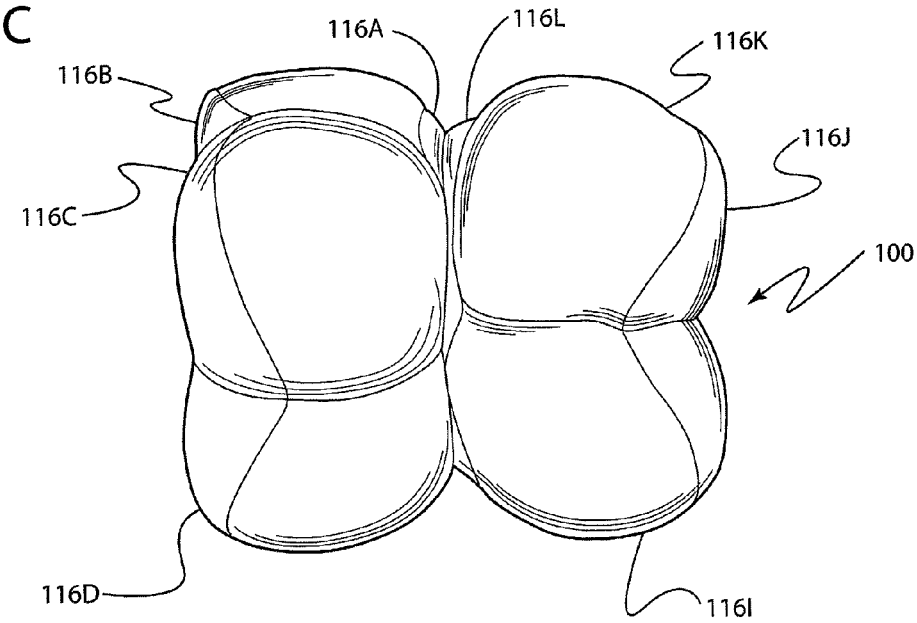
FIG. 2C is a rear elevational view of the reconfigurable pillow of FIG. 1A, showing the pillow in the bent configuration of FIG. 2A.
Figure 2D:
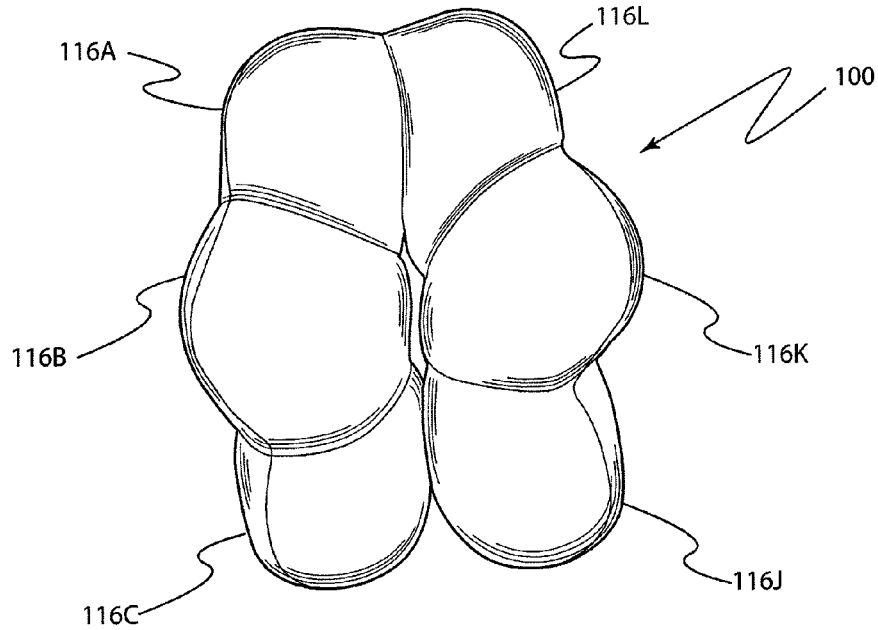
FIG. 2D is a top view of the reconfigurable pillow of FIG. 1A, showing the pillow in the bent configuration of FIG. 2A.

Front and back portions 104C-D are secured together at inner and outer peripheries 104A-B, in this example by sewing so as to create sewn seams 128, 132, respectively. In other embodiments, front and back portions 104C-D can be secured together in another manner, such as by using an adhesive or a welding technique, such as heat welding or chemical welding, among others. Those skilled in the art will recognize which technique(s) is/are suitable for the particular material(s) used. In this example, each of front and back portions 104C-D is made from twelve separate panels of material that correspond respectively to inter-constriction regions 116A-L and are joined together to like adjacent panels at corresponding respective seams 136, 140 located at corresponding respective ones of constrictions 112A-L. As can be readily envisioned, each of the twelve panels of front portion 104C and each of the twelve panels of back portion 104D are cut from sheet material and when flat have the general shape 152 shown in FIG. 1D.

In this embodiment, each constriction 112A-L has a pair of elastic strips 144A-B that assists in defining the shape and size of that restriction when pillow 100 is suitably filled with fill 108. Each of twelve elastic strips 144A (only one shown for convenience) in the particular example shown is sewn to back portion 104D along the corresponding respective seams 140 at constrictions 112A-L. When a nylon/spandex blend, or other stretchable material, is used for back portion 104D, each elastic strip 144A can be sewn continuously along each corresponding seam 140 so as to provide greater resistance to stretching at the corresponding constriction 112A-L, thereby assisting in defining the constricted shape of the constriction. In a similar manner, each of twelve elastic strips 144B (again, only one shown for convenience) in this example is sewn to front portion 104C along the corresponding respective seams 136 at constrictions 112A-L. In other embodiments in which elastic strips are used at constrictions and in which a substantially non-stretchable material is used, the elastic strips can be attached to the material using any of a variety of gathering techniques known in the art.

In the embodiment shown, pillow 100 also includes a longitudinally substantially non-stretchable reinforcing band 148 secured to envelope 104 at its inner periphery 104A, for example, by sewing. As described below, the non-stretchability of reinforcing band 148 makes inner periphery 104A of envelope 104 relatively highly non-stretchable, thereby contributing to the reconfigurability of pillow 100. Reinforcing band 148 can be made of any suitable non-stretchable material. Reinforcing band 148 can be a continuous loop of material or can be made up of a number of individual pieces that can, but need not, correspond to the number of inter-constriction regions 116A-L. While such individual pieces need not necessarily be joined with one another, they should work together to significantly inhibit the stretchability of inner periphery 104A.

Fill 108 plays an integral part in providing pillow 100 with the reconfigurability described above. Fill 108 is made of a plurality of discrete pieces of one or more materials that are able to move relative to one another as the pillow is folded, bent, twisted, etc. For the sake of this disclosure and claims appended hereto, this ability is termed "flowability" and is characterized by the pieces of material being able to be poured from a container in a fluid manner in the absence of static electricity or other constraining force. Such materials can either be relatively rigid or relatively elastic, depending on the use of pillow 100. Examples of flowable materials suitable for filler material include, but are not limited to, polymer beads (such as polystyrene beads), dried seeds or beans, and other materials that have relatively smooth contours and low-friction surfaces that allow pieces thereof to slide relatively easily over one another. In a particular example, fill 108 is made of 100% expanded polystyrene "micro-beads" having diameters on the order of 1 mm.

In order to achieve the desired reconfigurability of a pillow made in accordance with the present disclosure, fill 108 needs to be provided to envelope 104 in a suitable amount. Generally, a suitable amount will result in fill 108 being under positive pressure throughout the envelope when pillow is in the flat configuration of FIGS. 1A-C and is not subject to any forces other than the forces of resting on a horizontal surface. As those skilled in the art will readily appreciate, the suitable amount of fill 108 for an envelope of a particular size can vary depending on the type of fill material used and the material(s) from which the envelope is constructed. For example, if the fill material is packed too tightly, the resulting pillow will be too stiff and inflexible. At the opposite extreme, if envelope 104 is provided with so little fill material that there are voids in the envelope, pillow 100 will be limp and not able to be reconfigured as described above.

In an embodiment in which pillow 100 has at least one of front and back portions 104C-D made of a highly stretchable material, such as the nylon/spandex blend mentioned above, it is desirable to fill envelope 104 with enough fill 108 that, when the pillow is in a flat configuration, the stretchable material is stretched about 5% to 50% of its stretchability at each inter-constriction region 116A-L. In this case, fill 108 will have a positive (i.e., compressive) pressure throughout the interior of envelope 104. In this example, elastic strips 144A-B at corresponding respective constrictions 112A-L work against this expansive force, helping to define the shape and extent of the constrictions. As will be described below, constrictions 112A-L, along with the pressurized fill and other characteristics of pillow 100, form "soft hinges" that allow adjacent ones of inter-constriction regions 116A-L to generally pivot relative to one another, thereby allowing the pillow to bend. These soft hinges, along with the ability of fill 108 to flow and, in this example, the ability of at least one of front and back portions 104C-D to stretch as some of the fill shifts as pillow 100 is bent/folded/twisted, act in concert to enable the reconfigurability described above. It is noted that if envelope 104 is relatively non-stretchable of both front and back portions 104C-D, the reconfigurability of pillow 100 may still be possible by providing a suitable amount of fill 108 that includes a suitable amount of relatively elastically compressible pieces that still allow the fill to shift as the pillow is being manipulated into a new configuration.

Whereas FIGS. 1A-C show pillow 100 in a flat configuration for ease of describing the basic shape and features of the pillow, FIGS. 2A-D, 3B-C and 4B-C show the pillow in a few of the many configurations into which the pillow can be manipulated. Referring first to FIGS. 2A-D, these figures show pillow 100 folded into a "folded toroidal" shape in which, starting from the flat configuration of FIGS. 1A-C, the pillow is essentially folded over onto itself (as indicated by arrows 200 in FIG. 2A) and the various parts pushed together in a constricting manner (as indicated by arrows 204 in FIG. 2B) so that it generally has the appearance in top, side and bottom views of a rectangular solid consisting of twelve cells (formed by inter-constriction regions 116A-L) stacked two-high, three-in-a-row and two-deep. In this particular configuration, all twelve soft-hinges are active to some extent or another so as to permit this very compact shape. Pillow 100 can hold this configuration without outside constraint until re-manipulated into another configuration, such as the flat configuration of FIGS. 1A-C or either of the curved configurations of FIGS. 3B-C and FIGS. 4B-C. As can be readily seen in any one of FIGS. 2A-D, various parts of front and back portions 104C-D in inter-constriction regions 116A-L stretch or contract as the fill (FIG. 1C) shifts, or flows, inside envelope 104 as pillow 100 is manipulated into the folded toroidal shape of FIGS. 2A-D. Depending on the direction pillow 100 is bent at any particular constriction 112A-L, the fill can flow through that constriction from one adjacent inter-constriction region 116A-L to the other as needed to accommodate the pivoting of the corresponding soft hinge.

Figure 3A:
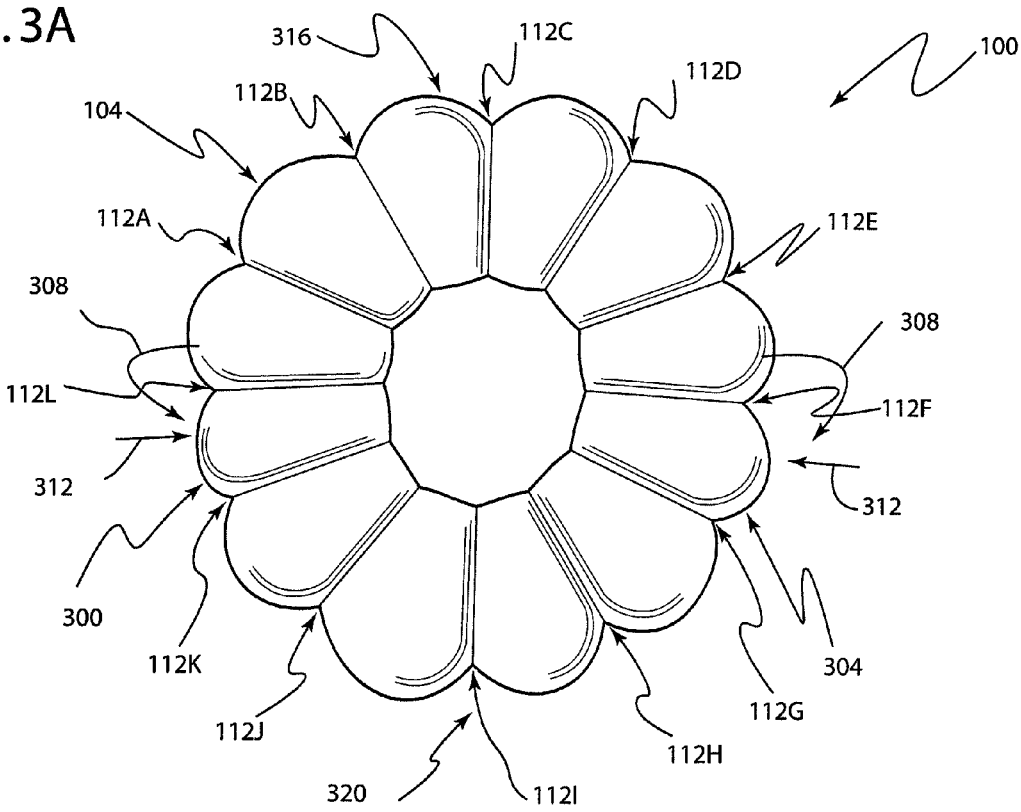
FIG. 3A is a front view of the reconfigurable pillow of FIG. 1A showing the pillow in a flat configuration and being subjected to a set of manipulations for changing the pillow into yet another bent configuration.
Figure 3B:
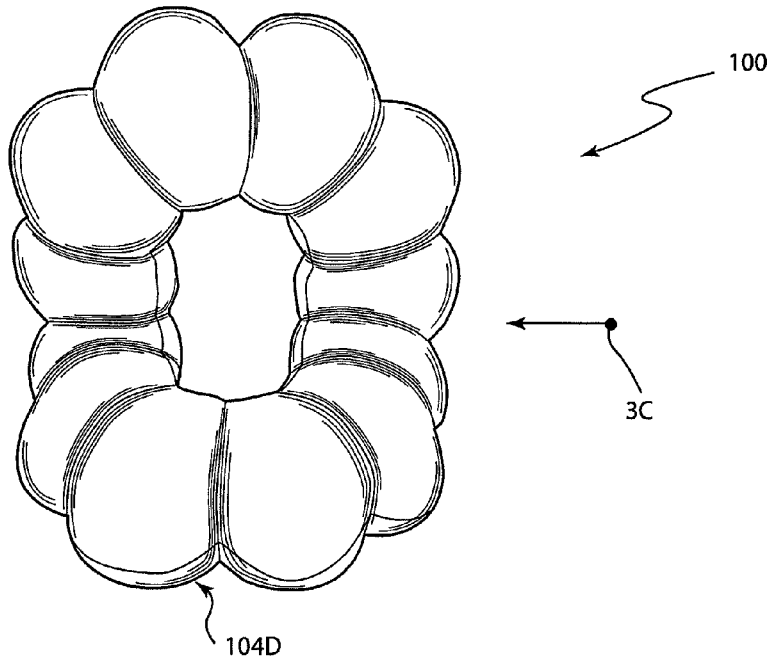
FIG. 3B is a side view of the reconfigurable pillow of FIG. 1A after twisting and moving together opposing sides of the pillow as illustrated in FIG. 3A.
Figure 3C:
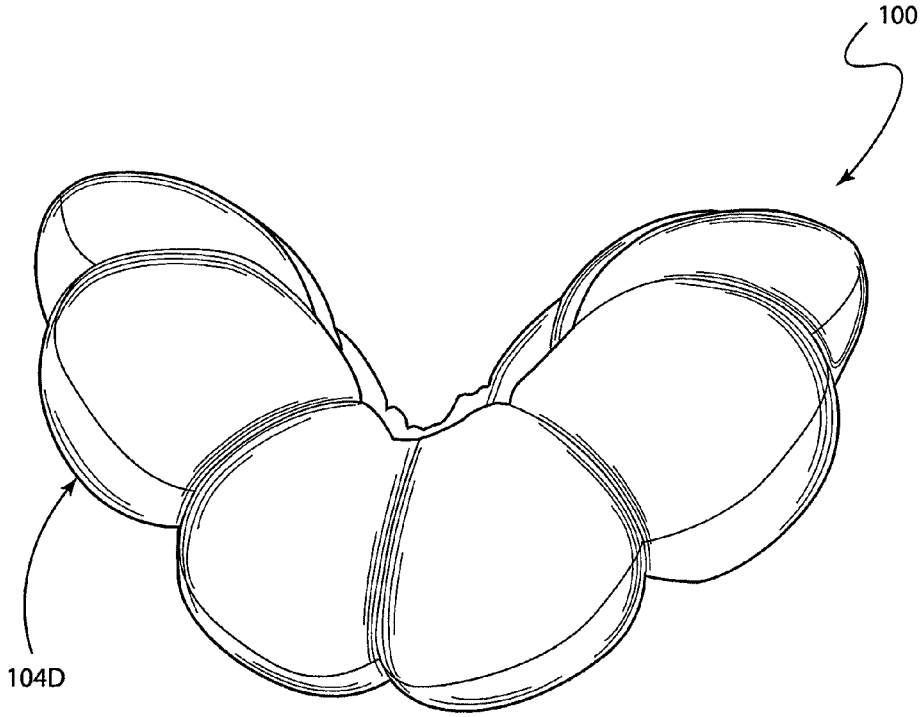
FIG. 3C is a view of the reconfigurable pillow of FIG. 3B as viewed from point 3C in FIG. 3B.

Referring now to FIGS. 3A-C, FIG. 3A shows pillow 100 in an initially flat configuration, like the configuration of FIGS. 1A-C. When a user grasps pillow 100 on opposing sides 300, 304 and simultaneously manipulates each side by twisting and moving each side as indicated by arrows 308, 312, top 316 and bottom 320 generally move upwardly (i.e., out of the page relative to FIG. 3A). If the user stops the manipulation after about 45° of twisting, pillow 100 will assume, and remain in until re-manipulated, the configuration shown in FIGS. 3B-C. Again, pillow 100 is able to retain this configuration by virtue of an interplay among various features of the pillow, including the soft-hinges formed at ones of constrictions 112A-L, the flow of the fill (see fill 108 of FIG. 1C) and the stretchability, in this example, of the back portion 104D of envelope 104.

Figure 4A:
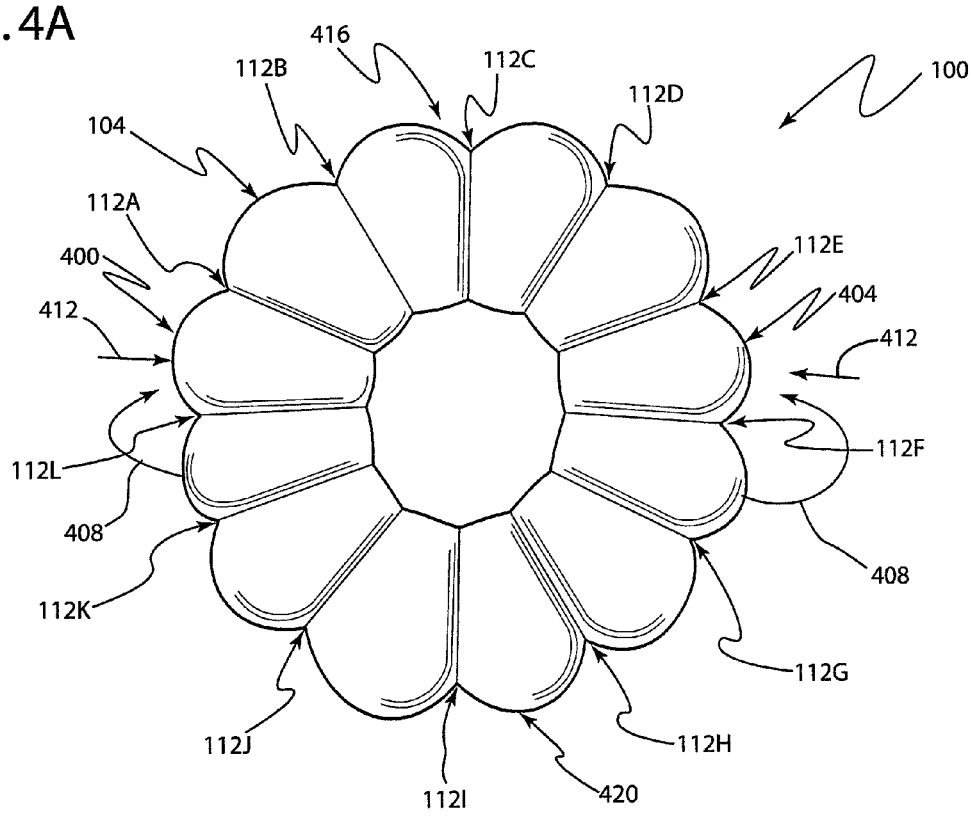
FIG. 4A is a front view of the reconfigurable pillow of FIG. 1A showing the pillow in a flat configuration and being subjected to a set of manipulations for changing the pillow into yet another bent configuration.
Figure 4B:
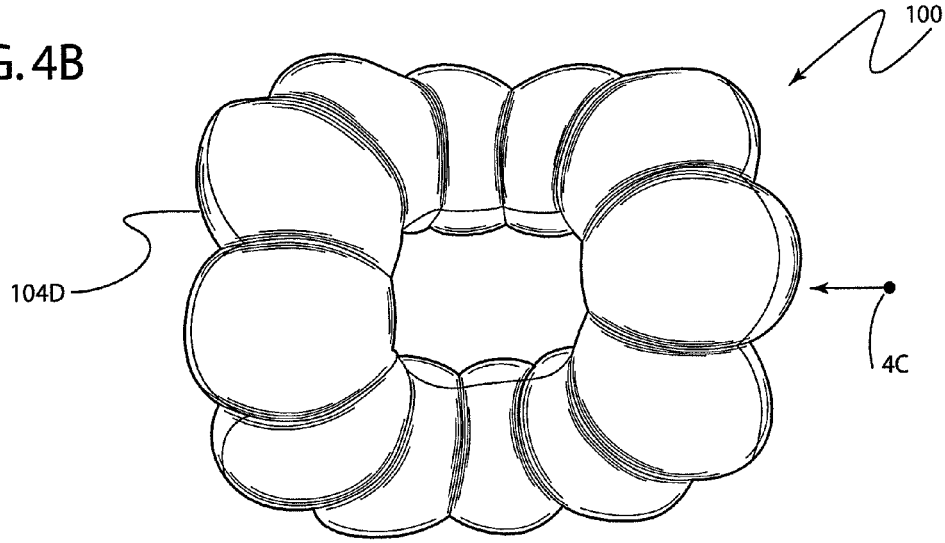
FIG. 4B is a side view of the reconfigurable pillow of FIG. 1A after twisting and moving together opposing sides of the pillow as illustrated in FIG. 4A.
Figure 4C:
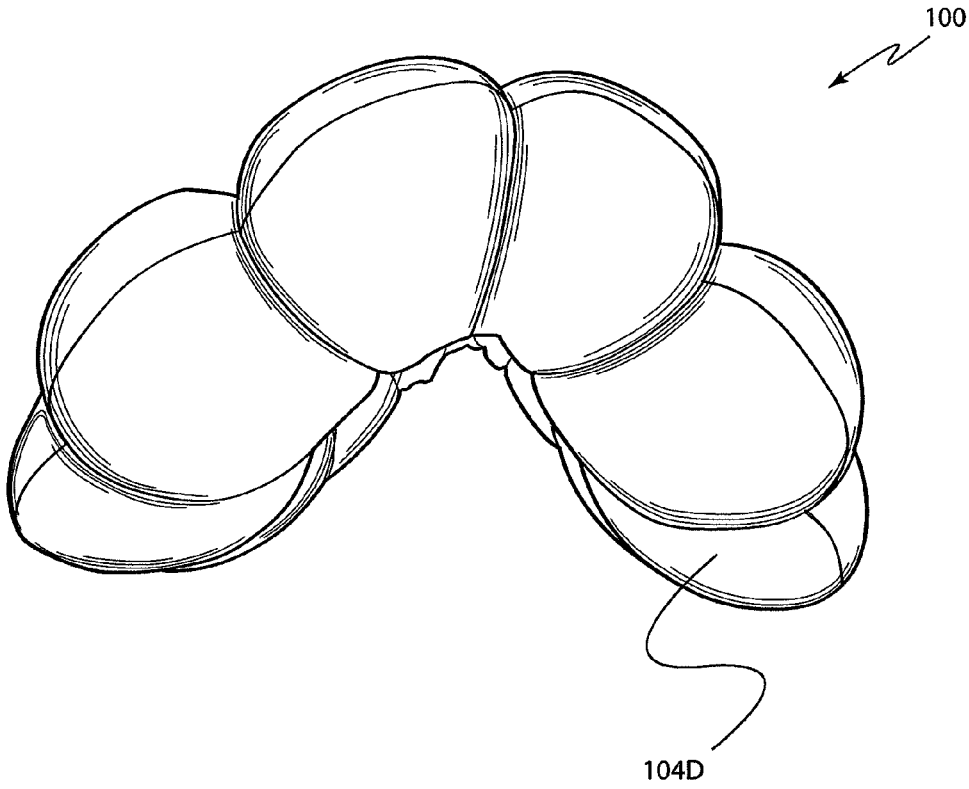
FIG. 4C is a front view of the reconfigurable pillow of FIG. 4B as viewed from point 4C in FIG. 4B.

FIG. 4A shows pillow 100 starting from the same flat configuration shown in FIG. 3A but being twisted in the direction opposite the direction of FIG. 3A. In FIG. 4A, opposing sides 400, 404 of pillow 400 are being twisted and moved in directions indicated by arrows 408, 412. In this case, top 416 and bottom 420 generally move backward (i.e., into the page as viewed in FIG. 4A), putting pillow 100 into the configuration depicted in FIGS. 4B-C. As described above, pillow 100 is able to retain this configuration by virtue of an interplay among various features of the pillow, including the soft-hinges formed at ones of constrictions 112A-L, the flow of the fill (see fill 108 of FIG. 1C) and the stretchability, in this example, of the back portion 104D of envelope 104. Those skilled in the art will readily recognize that a pillow made in accordance with the present disclosure, such as pillow 100, can be manipulated into a variety of configurations other than the configurations depicted in FIGS. 1A-4C.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A reconfigurable pillow, comprising:

a fill comprising a plurality of discrete pieces configured to make said fill flowable; and an envelope containing said fill, said envelope:

defining a generally toroidal shape;

having an inner peripheral region that is substantially non-stretchable; and including a plurality of transverse constrictions providing the reconfigurable pillow with a corresponding plurality of soft-hinges and with a corresponding plurality of inter-hinge regions located between adjacent ones of said plurality of soft-hinges, wherein said fill is flowable between adjacent ones of said plurality of inter-hinge regions;

wherein said fill is provided to said envelope in an amount such that when the reconfigurable pillow is bent from a first shape to a second shape, two or more of said plurality of soft-hinges activate to allow corresponding respective adjacent ones of said plurality of inter-hinge regions to rotate, and the reconfigurable pillow substantially maintains the second shape until the reconfigurable pillow is bent again.

2. A reconfigurable pillow according to claim 1, wherein said envelope includes a front portion and a back portion and at least one of said front and back portions substantially comprises a stretchable fabric.

3. A reconfigurable pillow according to claim 2, further comprising a plurality of elastic strips secured to the stretchable fabric at corresponding respective ones of said plurality of transverse constrictions.

4. A reconfigurable pillow according to claim 2, wherein said stretchable fabric has a stretchability of at least 40%.

5. A reconfigurable pillow according to claim 4, wherein said stretchability is at least 60%.

6. A reconfigurable pillow according to claim 4, wherein said stretchability is about 80%.

7. A reconfigurable pillow according to claim 2, wherein one of said front and back portions substantially comprises a substantially non-stretchable fabric.

8. A reconfigurable pillow according to claim 1, further comprising a non-stretchable reinforcing strip secured to said envelope at said inner periphery.

9. A reconfigurable pillow according to claim 1, wherein said fill comprises a plurality of elastic beads.

10. A reconfigurable pillow according to claim 9, wherein said fill comprises expanded polystyrene beads.

11. A reconfigurable pillow according to claim 1, wherein said envelope defines an interior cavity and said fill is provided within said interior cavity in an amount such that said fill is under positive pressure throughout said interior cavity without any forces being applied externally to the pillow.

12. A reconfigurable pillow according to claim 11, wherein at least one of said front and back portions comprises a stretchable material having a stretchability of at least 50% and said fill is provided so that, when the pillow is in a flat configuration, said stretchable material is stretched at least about 20% of said stretchability throughout that one of said first and second portions.

13. A reconfigurable pillow according to claim 12, wherein said stretchable material comprises a nylon/spandex blend.

14. A reconfigurable pillow according to claim 12, wherein the other of said front and back portions comprises a substantially non-stretchable material.

15. A reconfigurable pillow, comprising:

a flowable fill; and an envelope defining an interior cavity containing said flowable fill, said envelope:

defining a generally toroidal shape;

having a front portion that is generally circular;

having a back portion that is generally circular and connected to said front portion, wherein said back portion is made of a stretchable material having at least a stretchability of at least 50%;

having an inner peripheral region that is substantially non-stretchable;

including a plurality of transverse constrictions providing the reconfigurable pillow with a corresponding plurality of soft-hinges and with a corresponding plurality of inter-constriction regions located between adjacent ones of said plurality of transverse constrictions, wherein each of said plurality of transverse constrictions allows communication between adjacent ones of said plurality of inter-hinge regions; and a plurality of elastic strips secured to said stretchable material along corresponding respective ones of said plurality of constrictions;

wherein said flowable fill is provided within said interior cavity in an amount such that said flowable fill is under positive pressure throughout said interior cavity without any forces being applied externally to the pillow.

16. A reconfigurable pillow according to claim 15, wherein said flowable fill is provided to said envelope in an amount such that, when the pillow is in a flat configuration, said stretchable material is stretched at least about 20% of said stretchability throughout said plurality of inter-constriction regions.

17. A reconfigurable pillow according to claim 15, wherein said front portion of said envelope comprises a substantially non-stretchable material.

18. A reconfigurable pillow according to claim 15, wherein said envelope includes at least ten transverse constrictions.

19. A reconfigurable pillow according to claim 15, wherein said flowable fill consists essentially of expanded polystyrene beads.

20. A reconfigurable pillow according to claim 15, further comprising a substantially non-stretchable reinforcing strip secured to said envelope around said inner periphery.

* * * * *